US010099707B2

(12) United States Patent
Koerner et al.

(10) Patent No.: US 10,099,707 B2
(45) Date of Patent: Oct. 16, 2018

(54) BOGIE COMPRISING A WHEELSET DRIVE MOUNTED ON BEARINGS

(71) Applicant: SIEMENS AKTIENGESELLSCHAFT, München (DE)

(72) Inventors: Olaf Koerner, Nürnberg (DE); Hartmut Frank, Rochlitz (DE); Thomas Liebig, Dresden (DE); Thomas Oehler, Chemnitz (DE); Bernd Pfannschmidt, Rosstal (DE); Tobias Stärz, Pegnitz (DE)

(73) Assignee: Siemens Aktiengesellschaft, München (DE)

( * ) Notice: Subject to any disclaimer, the term of this patent is extended or adjusted under 35 U.S.C. 154(b) by 180 days.

(21) Appl. No.: 15/103,384

(22) PCT Filed: Dec. 10, 2014

(86) PCT No.: PCT/EP2014/077136

§ 371 (c)(1),
(2) Date: Jun. 10, 2016

(87) PCT Pub. No.: WO2015/086644

PCT Pub. Date: Jun. 18, 2015

(65) Prior Publication Data

US 2016/0325762 A1 Nov. 10, 2016

(30) Foreign Application Priority Data

Dec. 13, 2013 (EP) ..... 13197176

(51) Int. Cl.
*B61C 9/50* (2006.01)
*B61C 17/00* (2006.01)
(Continued)

(52) U.S. Cl.
CPC ..... *B61C 9/50* (2013.01); *B61C 3/00* (2013.01); *B61C 17/00* (2013.01); *B61F 5/00* (2013.01)

(58) Field of Classification Search
CPC .. B61C 17/00; B61C 3/00; B61C 9/50; B61C 9/44; B61C 9/48; B61C 9/52; B61C 9/38;
(Continued)

(56) References Cited

U.S. PATENT DOCUMENTS 1,783,269 A * 12/1930 Apple ..... B61C 9/46 105/137
3,323,764 A * 6/1967 Johnson ..... F16F 3/10 267/140.4

(Continued)

FOREIGN PATENT DOCUMENTS

CN 1240397 A 1/2000
DE 28 48 106 * 10/1980

(Continued)

OTHER PUBLICATIONS

EP 0 918 676 (English translation), 2 pages, Feb. 14, 2001 (Year: 2001).*

(Continued)

*Primary Examiner* — Mark T Le
(74) *Attorney, Agent, or Firm* — Henry M. Feiereisen LLC

(57) ABSTRACT

A bogie (6) comprises a bogie frame (7). The bogie frame (7) is mounted on bearings (7*b*) via a first spring device (7*a*). A wheelset shaft (8) is mounted in the bearings (7*b*). A wheelset drive (9) concentrically surrounds the wheelset shaft (8) and acts thereupon. The wheelset drive (9) is spring-mounted on the bearings (7*b*) by means of a second spring device (16) exclusively associated with the wheelset drive (9). A two-level clutch (15) is arranged between the wheelset drive (9) and the wheelset shaft (8).

10 Claims, 5 Drawing Sheets

(51) Int. Cl.
*B61C 3/00* (2006.01)
*B61F 5/00* (2006.01)

(58) Field of Classification Search
CPC .... B61C 15/02; B61F 5/00; B61F 3/04; B61F 3/06; B61F 5/02; F16F 1/40; B60G 2202/143
USPC ..... 105/133, 136, 137, 138, 139, 140; 267/140.4
See application file for complete search history.

(56) References Cited

U.S. PATENT DOCUMENTS 4,411,202 A * 10/1983 Kreissig ..... B61F 5/02 105/136
6,637,344 B2 * 10/2003 Martin ..... B61F 3/02 105/157.1
2010/0282122 A1 * 11/2010 Mai ..... B60L 7/10 105/1.4

FOREIGN PATENT DOCUMENTS

| | | | |
|---|---|---|---|
| EA | 014035 | B1 | 8/2010 |
| EP | 0 918 676 | B1 | 2/2001 |
| FR | 957 762 | A | 2/1950 |
| JP | H08150928 | A | 6/1996 |
| JP | H11301471 | A | 11/1999 |
| JP | 2008154401 | A | 7/2008 |
| SU | 1273665 | * | 11/1986 |

OTHER PUBLICATIONS

Blaser E et al: "Achsantriebe für elektrische Schienenfahrzeuge" Brown Boveri Review, Brown Boveri and Co. Baden; vol. 64; pp. 714-723; XP000764887 ; 1977.

* cited by examiner

BOGIE COMPRISING A WHEELSET DRIVE MOUNTED ON BEARINGS

CROSS-REFERENCES TO RELATED APPLICATIONS

This application is the U.S. National Stage of International Application No. PCT/EP2014/077136, filed Dec. 10, 2014, which designated the United States and has been published as International Publication No. WO 2015/086644 and which claims the priority of European Patent Application, Serial No. 13197176.4, filed Dec. 13, 2013, pursuant to 35 U.S.C. 119(a)-(d).

BACKGROUND OF THE INVENTION

The present invention relates to a bogie, wherein the bogie has a bogie frame, wherein the bogie frame is spring-mounted on bearings via a first spring device, wherein a wheelset shaft of a wheelset is mounted in the bearings, wherein a wheelset drive concentrically surrounds the wheelset shaft and acts on the wheelset shaft.

Such a bogie is known for example from EP 0 918 676 B1. With this bogie the wheelset drive is mounted directly on the wheelset shaft. An elastic support is realized on the side facing away from the gearing mechanism. A connection with a clutch, which for its part is supported against the wheelset shaft by elastic elements, is realized on the side facing towards the gearing mechanism.

Drives for rail vehicles are known in a very wide variety of embodiments. Thus for example the name INTRA ICE refers to a drive in which the wheelset drive surrounds the wheelset shaft concentrically and acts directly on the wheelset shaft. Furthermore a wheel hub drive with integrated planetary gear train is known for streetcars and the like, in which the drive is integrated directly into the running wheel of the rail vehicle.

SUMMARY OF THE INVENTION

The object of the present invention consists in embodying a bogie of the type stated at the outset so that a bogie is created of which the drive acts on the wheelset shaft by means of a simple, reliable, practically maintenance-free and easy-to-install construction, wherein the unsprung masses are still kept small.

The object is achieved by a bogie having bogie frame spring-mounted on bearings via a first spring device, a wheelset having a wheelset shaft mounted in the bearings, a wheelset drive surrounding the wheelset shaft concentrically and acting on the wheelset shaft, the wheelset drive being spring-mounted on the bearings via a second spring device which is exclusively associated with the wheelset drive, and a two-level clutch arranged between the wheelset drive and the wheelset shaft. Advantageous embodiments of the inventive bogie are the subject matter of the dependent claims.

In accordance with the invention a bogie of the type stated at the outset is embodied in that, the wheelset drive is spring-mounted on the respective bearings by means of a second spring device exclusively associated with the wheelset drive and the bearings, and a two-level clutch is arranged between the wheelset drive and the wheelset shaft.

Preferably the two-level clutch is embodied as a double-toothed clutch. This enables the space required for the two-level clutch to be kept to a minimum.

Running wheels of the wheelset are arranged at ends of the wheelset shaft spaced apart from one another. The space requirement for the bogie can be further minimized by the bearings being arranged between the wheels of the wheelset.

The second spring device can be embodied as a group of buffer elements made of permanently-elastic material ("rubber buffer"). This embodiment is especially low-cost and low-maintenance. As an alternative the second spring device can be embodied as a group of coil springs. By means of such spring devices a large spring travel can especially be realized in a simple manner. Damping is also realized in addition to the springing. It is possible for the second spring device itself to already act as a damper. As an alternative there can be self-contained damping elements present.

It is possible for the wheelset drive to act on the wheelset shaft without there being a gearing mechanism arranged between the two. As an alternative there can be a gearing mechanism present. In this case the wheelset drive acts via the gearing mechanism on the wheelset shaft. The gearing mechanism in this case is arranged between the wheelset drive and the two-level clutch.

If they are present, the gearing mechanism can be embodied as required. In practice it has proved advantageous for the gearing mechanism to be embodied as a planetary gear train. In this case the planetary gear train can especially have a hollow-bored sun wheel arranged on a rotor shaft of the wheelset drive in a torsion-proof manner. The wheelset shaft in this case is preferably connected in a torsion-proof manner to a planetary carrier of the planetary gear train via the two-level clutch.

The wheelset drive is connected by means of traction current converters to an electrical power supply. In the prior art the traction current converters are usually arranged on the roof of the car body of the rail vehicle. In some cases they are arranged under the floor between the bogies of the rail vehicle. As a result of the compact structure of the wheelset drive of the bogie of the present invention it is possible for the corresponding traction current converters to be arranged on the bogie itself. The result achieved by this is that the traction current converters become a part of a compact, autonomous bogie with a simple interface to the car body.

In the simplest case the traction current converters are arranged directly on the bogie frame. In this case they are sprung exclusively via the first spring device (so-called primary springing). Through this they are subject to increased vibration and shock loadings during operation. In order to keep these types of increased vibration and shock loadings away from the car body, as a rule a car body carrier sprung relative to the bogie frame is supported on the bogie frame via a third spring device. This springing is in practice mostly referred to as secondary springing. The car body itself is connected via the car body carrier to the bogie. In a preferred embodiment the traction current converters are arranged on an underside of the car body carrier. This enables the bogie (including the current converter arranged on the bogie) to continue to be kept compact and autonomous. The simple interface to the car body can also be retained. Through the arrangement of the current converters on the car body carrier the vibration and shock loadings are however reduced to the degree (or below) to which they are also subjected with a conventional arrangement—i.e. on the roof of the rail vehicle or under the floor between the bogies.

DESCRIPTION OF THE DRAWING

The characteristics, features and advantages of this invention described above, as well as the manner in which these are achieved, will become clearer and easier-to-understand in conjunction with the description of the exemplary embodiments given below, which are explained in greater detail in connection with the drawings, in which, in schematic diagrams.

BRIEF DESCRIPTION OF PREFERRED EMBODIMENTS

Figure 1:
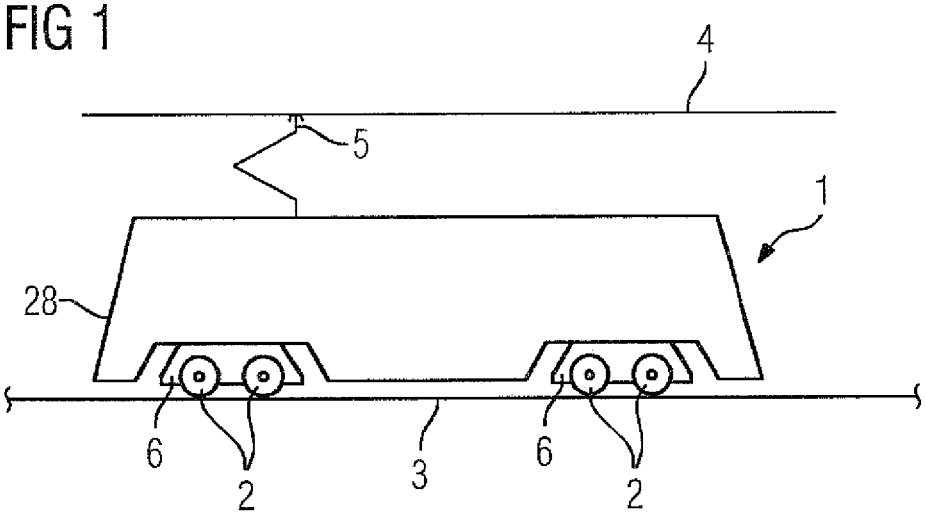
FIG. 1 shows a rail vehicle.

In accordance with FIG. 1, a rail vehicle 1 with wheels 2 rolls on rails 3. The rail vehicle 1 is driven electrically. It takes electrical current from an overhead line 4 by means of a pantograph 5. As an alternative a power supply is possible via a third rail for example, via an energy store arranged on the rail vehicle 1 or via an internal combustion engine arranged on the rail vehicle 1.

The rail vehicle 1 has several—as a rule two—bogies 6. The embodiment of the bogies 6 is the subject matter of the present invention. The embodiment of one of the bogies 6 will be explained in greater detail below in conjunction with FIGS. 2 to 4. The other bogies 6 can be embodied likewise.

Figure 2:
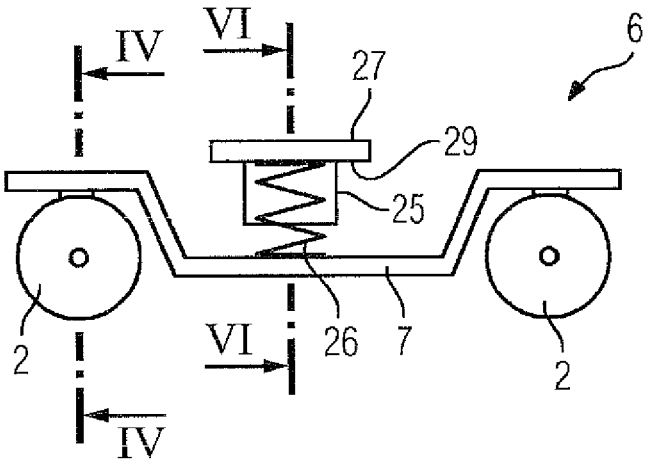
FIG. 2 shows a bogie from the side.
Figure 3:
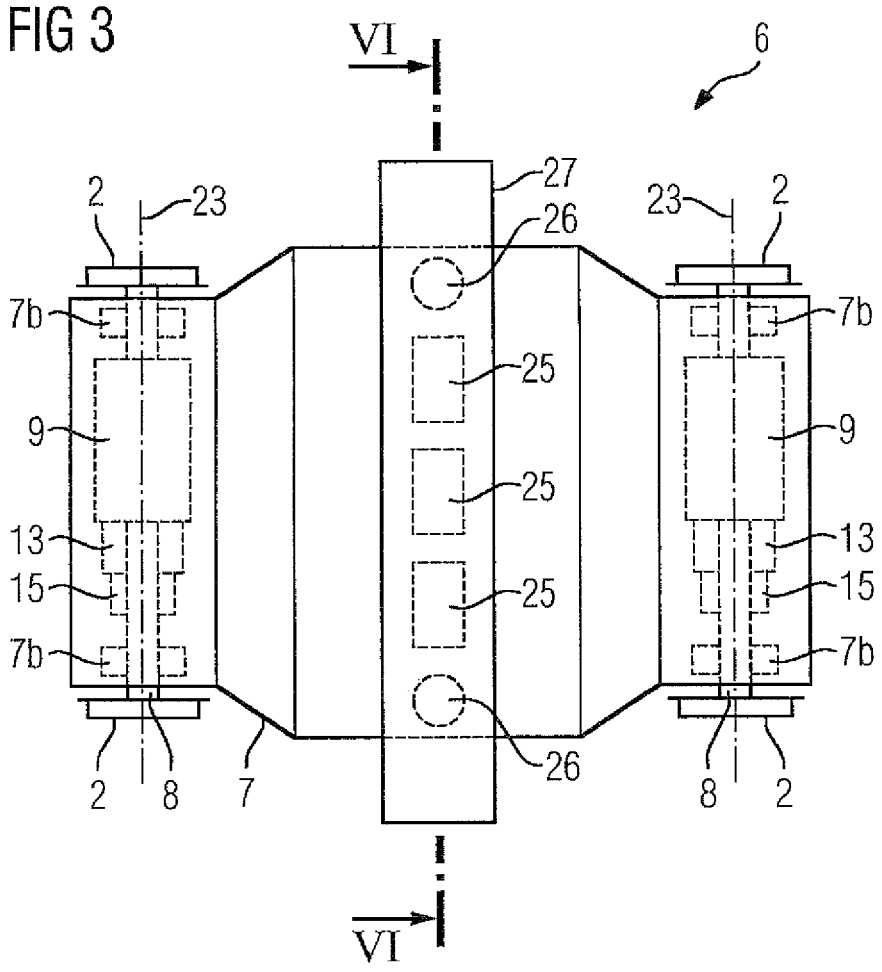
FIG. 3 shows the bogie from FIG. 2, from above.
Figure 4:
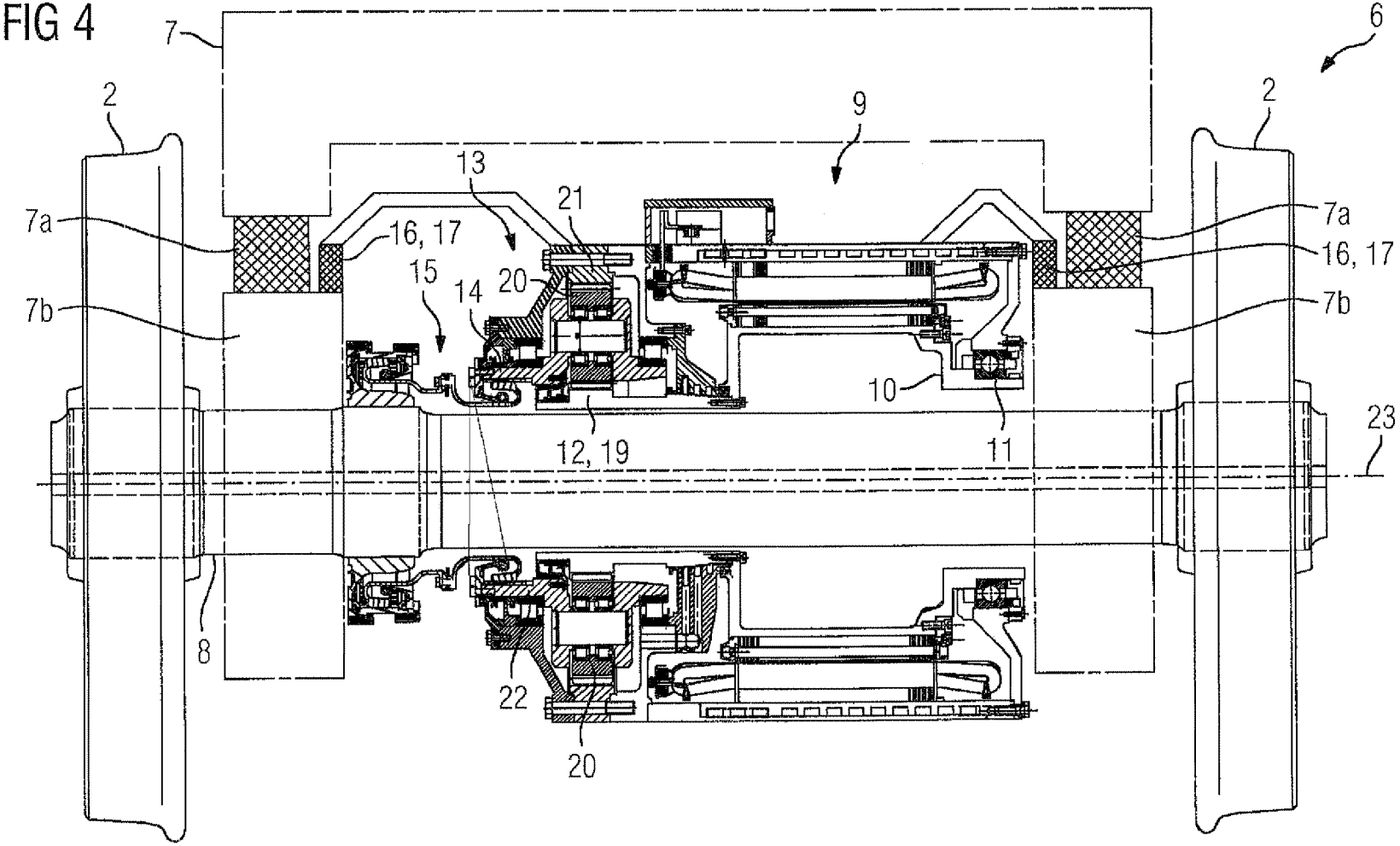
FIG. 4 shows a section through the bogie of FIGS. 2 and 3 along a line labeled IV-IV in FIG. 2.

According to FIGS. 2 to 4 the bogie 6 has a bogie frame 7. The bogie frame 7 is spring-mounted via a first spring device 7*a* (primary springing) on bearings 7*b*. Supported in the bearings 7*b* is a wheelset shaft 8 of a wheelset. A wheelset, as is generally usual, consists of the wheelset shaft 8 and the two wheels 2 on the ends of the wheelset shaft 8 connected to the wheelset shaft 8 in a torsion-proof manner. Preferably, in accordance with the drawings in FIGS. 2 to 4, the bearings 7*b* are arranged between the wheels 2 of the wheelset. Mostly a number of wheelsets are mounted on the bogie 6, for example two or in individual cases also three wheelsets. The number of wheelsets per bogie 6 is of minor significance however.

The wheelset shaft 8 is provided with a wheelset drive 9, which—see FIG. 4—surrounds the wheelset shaft 8 concentrically. The wheelset drive 9 has a rotor shaft 10, which is supported rotatably in the wheelset drive 9 in drive bearings 11. The rotor shaft, in accordance with FIGS. 2 to 4 is connected in a torsion-proof manner to an input shaft 12 of a gearing mechanism 13. An output shaft 14 of the gearing mechanism 13 acts on the wheelset shaft 8 via a two-level clutch 15. As an alternative the gearing mechanism 13 can be omitted. In this case the rotor shaft 10 would be connected directly to the two-level clutch 15.

The wheelset drive 9 as such can be embodied as required. It can be embodied for example as an—especially high-pole—synchronous machine with permanent-magnetic excitation and radial flux construction. As an alternative however other embodiments are possible, such as asynchronous machines for example, reluctance machines (with or without permanent-magnetic excitation) and also others. The cooling of the wheelset drive 9 can be embodied as required as water jacket cooling, as air cooling or as vehicle movement wind cooling etc.

Figure 5:
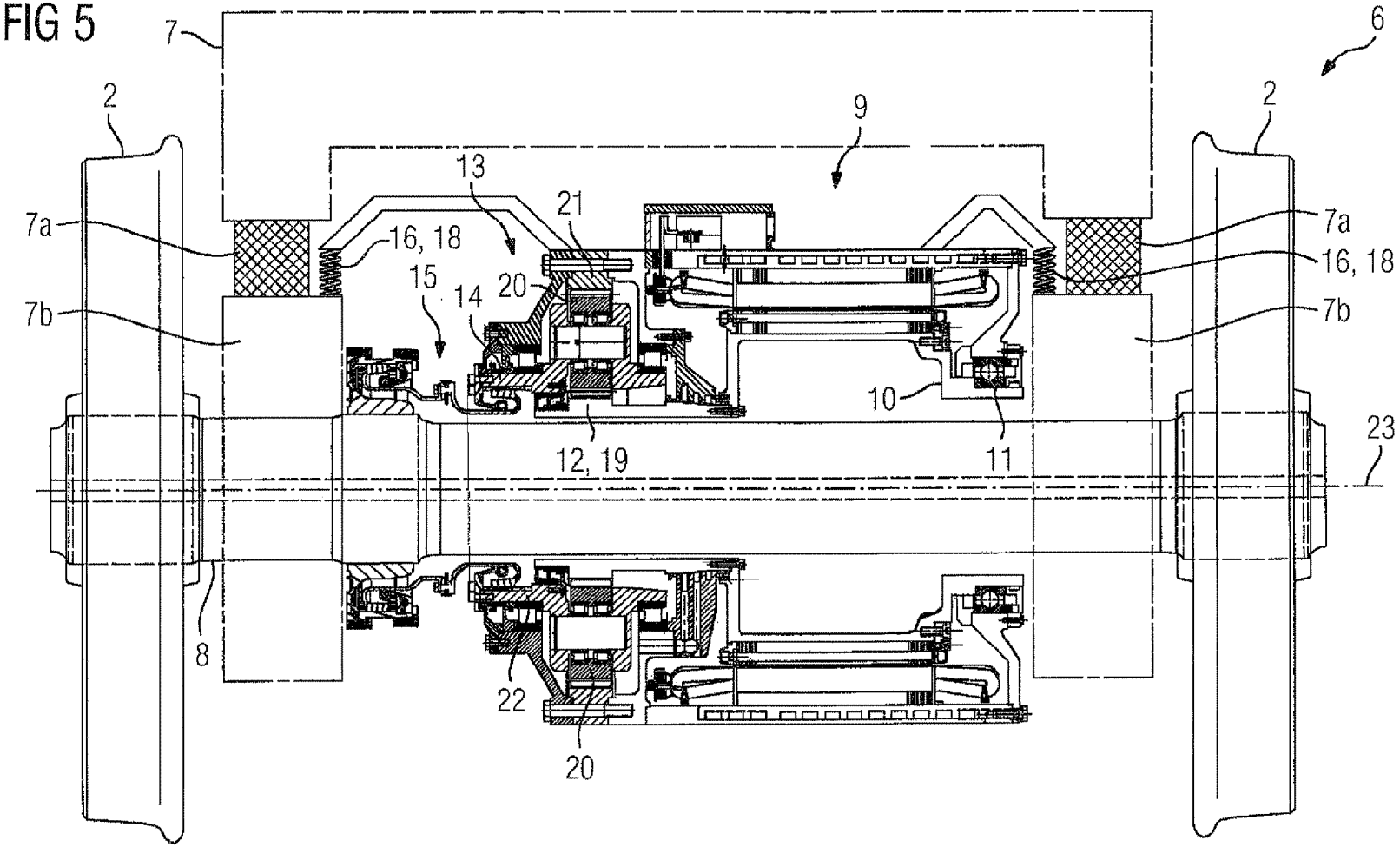
FIG. 5 shows an alternate embodiment to FIG. 4.

The wheelset drive 9 is arranged for both axial and radial movement relative to the wheelset shaft 8. An angular movement, i.e. a tilting of the wheelset drive 9 relative to the wheelset shaft 8, is possible. For this purpose the wheelset drive 9 is spring mounted on the respective bearings 7*b* by means of a second spring device 16. The second spring device 16 can be embodied for example in accordance with the diagram shown in FIG. 4 as a group of buffer elements 17, wherein the buffer elements 17 consist of a permanently-elastic material. The permanently-elastic material can be a metal-rubber mixture for example. As an alternative the second spring device 16 can be embodied as shown in the diagram in FIG. 5 as a group of coil springs 18.

The gearing mechanism 13 can be embodied as a planetary gear train for example. In this case the gearing mechanism 13 has a sun wheel 19, a number of planetary wheels 20 and a hollow wheel 21. The sun wheel 19 is preferably hollow-bored and is arranged in a torsion-proof manner on the rotor shaft 10. The sun wheel 19 corresponds to the input shaft 12. The hollow wheel 21 is preferably arranged in a torsion-proof manner on the wheelset drive 9. The planetary wheels 20 are arranged on a planetary carrier 22. The planetary carrier 22 preferably corresponds to the output shaft 14. The wheelset shaft 8 is connected in the case of this embodiment in a torsion-proof manner via a two-level clutch 15 to the planetary carrier 22 of the planetary gear train 13.

The two-level clutch 15 is capable of compensating for both radial movements and also axial movements and also tilting movements of the wheelset drive 9 relative to an axis of rotation 23 of the wheelset shaft 8. Preferably the two-level clutch 15 is embodied for this purpose as a double-toothed clutch. Double-toothed clutches are known to persons skilled in the art as such and therefore do not have to be explained in any greater detail.

The bogie frame 6 explained above is a very compact design. In particular it is possible, in the form described with gearing mechanism 13, for the gearing mechanism 13, viewed in the direction of the axis of rotation 23, to only need approximately 20% to approximately 35% of the space available for the drive of the wheelset shaft 8. The remaining 65% to 80% of the space is thus available for the actual wheelset drive 9. The wheelset drive 9 can therefore—compared to a direct drive, with which no gearing mechanism is present—apply approximately 65% to 80% of its torque. However a relatively high reduction is able to be achieved by means of the gearing mechanism 13, of approximately 3:1 for example. The effective torque, especially required when starting up, can therefore lie at 200% to approximately 250% of the torque that would have been able to be exerted on the wheelset shaft 8 by means of a direct drive needing the same installation space as the wheelset drive 9, including gearing mechanism 13.

Figure 6:
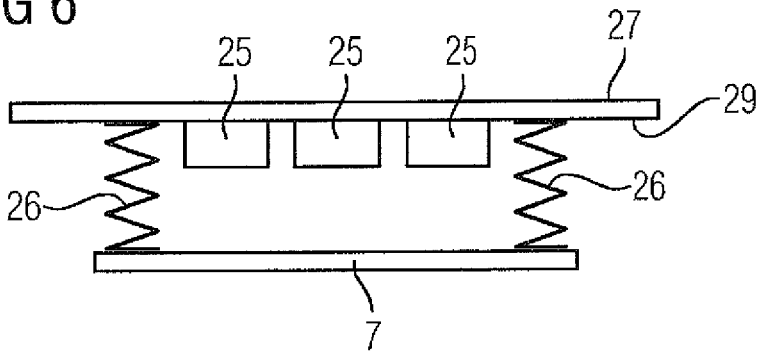
FIG. 6 shows a section through the bogie of FIGS. 2 and 3 along a line labeled VI-VI in FIGS. 2 and 3.

Furthermore the wheelset drive 9 of the inventive bogie 6, even viewed in the direction of travel, only requires a relatively small installation space. Therefore—compared with conventional bogies 6—a shortening of the bogie 6 or a utilization of the installation space for other purposes is possible. In particular it is possible, in accordance with the diagram in FIG. 6, to arrange traction current converters 25 in this installation space and thus especially on the bogie 6 itself. The wheelset drive 9 is connected to an electrical power supply, for example the overhead line 4 already mentioned, during operation by means of traction current converters 25.

In principle it is possible to arrange the traction current converters 25 directly on the bogie frame 7. In this case the traction current converters 25 would be almost unsprung or only primarily sprung. However a car body carrier 27 is supported on the bogie frame 7 via a third spring device 26 (secondary springing). The car body carrier 27, with a bogie 6 mounted on a rail vehicle 1, is rigidly connected to a car body 28 (see FIG. 1) of the rail vehicle 1. The car body carrier 27 can be embodied as a cross member in accordance with the diagrams shown in FIGS. 3 and 6 for example. Preferably the traction current converters 25 are arranged in accordance with the diagram in FIG. 6 on an underside 29 of the car body carrier 27.

The present invention has many advantages. In particular an integrated, compact-design, concentric wheelset drive 9 with or without gearing mechanism 13 can be realized in a simple manner. With gearing mechanism the inventive bogie 6 makes a high startup or braking torque possible. It is especially suitable for rail vehicles 1 that have to start and stop frequently, such as rail vehicles 1 in local mass transit traffic for example. It is further possible to integrate the traction current converters 25 into the bogie 6 as well. This embodiment means that space that can be used in other ways continues to be free in the underfloor area.

In summary the present invention relates to the following subject matter:

A bogie 6 has a bogie frame 7. The bogie frame 7 is spring-mounted on bearings 7*b* via a first spring device 7*a*. A wheelset shaft 8 of a wheelset is supported in the bearings 7*b*. A wheelset drive 9 surrounds the wheelset shaft 8 concentrically. It acts on the wheelset shaft 8. The wheelset drive 9 is spring-mounted on the respective bearings 7*b* by means of a second spring device 16 exclusively associated with the wheelset drive 9 and the bearings 7*b*. A two-level clutch 15 is arranged between the wheelset drive 9 and the wheelset shaft 8.

Although the invention has been illustrated and described in greater detail by the preferred exemplary embodiments, the invention is not restricted by the disclosed examples and other variations can be derived herefrom by the person skilled in the art, without departing from the scope of protection of the invention.

What is claimed is:

1. A bogie, comprising:

a bogie frame;

a first spring device;

bearings configured to support the bogie frame via the first spring device, wherein the first spring device is directly connected to the bogie frame and the bearings;

a wheelset having a wheelset shaft mounted in the bearings;

a wheelset drive disposed in concentric surrounding relationship to the wheelset shaft and acting on the wheelset shaft;

a second spring device configured to spring-mount the wheelset drive on the bearings, said second spring device being exclusively associated with the wheelset drive and the bearings, wherein the second spring device is directly connected to the wheelset drive and the bearings; and a two-level clutch arranged between the wheelset drive and the wheelset shaft.

2. The bogie of claim 1, wherein the two-level clutch is configured as a double-toothed clutch.

3. The bogie of claim 1, wherein the wheelset has wheels arranged at ends of the wheelset shaft in spaced-apart relation from one another, said bearings being arranged between the wheels of the wheelset.

4. The bogie of claim 1, wherein the second spring device is configured as a group of buffer elements made of permanently-elastic material.

5. The bogie of claim 1, wherein the second spring device is configured as a group of coil springs.

6. The bogie of claim 1, further comprising a gearing mechanism arranged between the wheelset drive and the two-level clutch, said wheelset drive acting on the wheelset shaft via the gearing mechanism.

7. The bogie of claim 6, wherein the gearing mechanism is configured as a planetary gear train.

8. The bogie of claim 7, wherein the wheelset drive has a rotor shaft, said planetary gear train including a hollow-bored sun wheel arranged in fixed rotative engagement on the rotor shaft of the wheelset drive, said wheelset shaft being connected to a planetary carrier of the planetary gear train in fixed rotative engagement via the two-level clutch.

9. The bogie of claim 1, further comprising traction current converters arranged on the bogie and configured to connect the wheelset drive to an electrical power supply.

10. The bogie of claim 1, further comprising a car body carrier and a third spring device configured to spring-mount the car body carrier on the bogie frame, said traction current converters being arranged on an underside of the car body carrier.

* * * * *